US008592758B1

(12) United States Patent
Nilles et al.

(10) Patent No.: US 8,592,758 B1
(45) Date of Patent: Nov. 26, 2013

(54) VAPOR SAMPLING ADAPTER FOR DIRECT ANALYSIS IN REAL TIME MASS SPECTROMETRY

(75) Inventors: John M. Nilles, Elkridge, MD (US); Theresa R. Connell, Bel Air, MD (US); H. Dupont Durst, Bel Air, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/153,832

(22) Filed: Jun. 6, 2011

(51) Int. Cl.
*H01J 49/00* (2006.01)
*H01J 49/10* (2006.01)

(52) U.S. Cl.
USPC ..... 250/288; 250/423 R

(58) Field of Classification Search
USPC ..... 250/288, 423 R
See application file for complete search history.

(56) References Cited

U.S. PATENT DOCUMENTS

| | | | | |
|---|---|---|---|---|
| 3,754,730 | A * | 8/1973 | Nilles et al. | 251/28 |
| 7,700,913 | B2 * | 4/2010 | Musselman | 250/288 |
| 7,705,297 | B2 * | 4/2010 | Musselman | 250/288 |
| 7,714,281 | B2 * | 5/2010 | Musselman | 250/288 |
| 2005/0196871 | A1 * | 9/2005 | Cody et al. | 436/173 |
| 2005/0230498 | A1 * | 10/2005 | Ruediger et al. | 239/338 |
| 2007/0176113 | A1 * | 8/2007 | Shiea et al. | 250/423 P |
| 2008/0067359 | A1 * | 3/2008 | Musselman | 250/290 |
| 2009/0302211 | A1 * | 12/2009 | Takats | 250/282 |
| 2010/0019140 | A1 * | 1/2010 | Amirav et al. | 250/282 |
| 2010/0096544 | A1 * | 4/2010 | Slivon et al. | 250/282 |
| 2010/0258717 | A1 * | 10/2010 | Chen et al. | 250/288 |
| 2011/0201126 | A1 * | 8/2011 | Hughes | 436/175 |
| 2011/0204220 | A1 * | 8/2011 | van Wuijckhuijse et al. | 250/282 |
| 2011/0253903 | A1 * | 10/2011 | Sun et al. | 250/426 |
| 2012/0278002 | A1 * | 11/2012 | Call et al. | 702/22 |

* cited by examiner

*Primary Examiner* — David A Vanore
*Assistant Examiner* — Wyatt Stoffa
(74) *Attorney, Agent, or Firm* — Ulysses John Biffoni

(57) ABSTRACT

A vapor sampling adapter for direct analysis in real time mass spectrometer (DART-MS) applications comprises a vapor transport line and a manifold. In the preferred embodiment the vapor transport line is heated and approximately 20 feet in length. This provides a means to utilize the highly accurate and reliable DART-MS device to detect chemical agents at sample location points up to 20 feet away from the device with the ability to easily move the sampling point to any desired point within the sampling range, thus allowing the operator to systematically scan a site in a fashion similar to that used with a handheld detector. Sample vapor flows through the vapor transport line to the manifold where it comes in proximity to the ion generator of the DART mass spectrometer before entering into the mass spectrometer for analysis. The present invention may be used to raster a surface to determine the precise location of chemical agent contamination. Additionally, the invention may be used to tune or calibrate a DART-MS.

9 Claims, 7 Drawing Sheets

VAPOR SAMPLING ADAPTER FOR DIRECT ANALYSIS IN REAL TIME MASS SPECTROMETRY

GOVERNMENTAL INTEREST

The invention described herein may be manufactured, used and licensed by or for the U.S. Government.

TECHNICAL FIELD

This invention relates generally to the field of analytical chemistry. More particularly, the invention relates to the field of mass spectrometry using direct analysis in real time.

BACKGROUND

Given the need to assess, decontaminate, and verify decontamination of a facility for reoccupation after possible chemical agent contamination, various techniques and instruments have been developed for use by the personnel who perform this hazardous work. When performing such tasks in a contaminated or potentially contaminated environment, specially trained workers must wear cumbersome personal protective equipment (PPE). The PPE typically includes a chemical agent resistant hooded garment with gloves, boots, and respirator equipment. Handheld chemical agent detectors, sampling kits, and decontamination kits are commercially available and used in these applications. However, the accuracy and reliability of such handheld chemical agent detectors are compromised to some extent in order to achieve the size restrictions needed for portability. Accordingly, it is standard practice to hand gather a larger number of samples for subsequent analysis. A large number of samples are gathered because the exact location of contamination is generally unknown. Follow-on analysis is then typically performed at a laboratory using stationary, but highly accurate and reliable analytical equipment. In addition to being inefficient from a labor perspective in both the collection and subsequent analysis time, this prior art technique places personnel at greater risk. This is due to the longer duration needed to collect numerous samples with little to no feedback on the precise location of the chemical agent contamination.

Mass spectrometry (MS) using direct analysis in real time (referred to under the trademark DART or DART-MS) ionization provides a preferred analytical means for subsequent laboratory analysis of the samples collected in the application described above. The DART coupled with an appropriate MS system provides highly accurate and reliable analytical results in this application. Detailed teachings to enable practice of DART-MS ionization systems are provided in U.S. Pat. No. 7,112,785 entitled "Method for Atmospheric Pressure Analyte Ionization" and U.S. Pat. No. 7,196,525 entitled "Sample Imaging," both of which are incorporated herein by reference in their entirety.

When using a DART-MS system, such as the JEOL DART-AccuTOF described in the above-incorporated patents, it is generally a required element of the operation to bring the sample to be analyzed in close proximity to the ion source of the DART-MS where it is typically held by hand in such proximity until a reading on the DART-MS is obtained.

While some attempts have been made to provide a sample line for greater convenience and flexibility while using the DART-MS, these attempts have generally focused on moving the ion source to the sampling point and transporting the resulting ions through the sample line to the MS. The generation of ions and their subsequent transportation has been fraught with limitations because it is inherently difficult to move ionized species over the desired distances, such as 10 to 20 feet, at atmospheric pressure. Losses over even shorter distances such as 3 feet can occur through multiple pathways including gas and surface reactions as well as charge neutralization. Accordingly, handheld detectors for onsite analysis coupled with sampling kits for offsite laboratory analysis have proliferated in this application. In addition, many subject matter experts teach away from attempting to bring high value, sensitive instruments such as the DART-MS into potentially contaminated sites.

Accordingly, what is needed is a means to utilize the highly accurate and reliable DART-MS device to detect chemical agents at sample location points approximately 20 feet away from the device with the ability to easily move the sampling point to any desired point within the sampling range, thus allowing the operator to systematically scan a site in a fashion similar to that used with a handheld detector.

SUMMARY

The present invention provides a vapor sampling adapter for use with a DART-MS system. It includes a vapor transport line and a manifold. In the preferred embodiment the vapor transport line is heated and approximately 20 feet in length. This provides a means to use the highly accurate and reliable DART-MS to detect chemical agents at points up to 20 feet away from the DART-MS and easily move sampling to any point within the reach of the transport line. This allows the operator to systematically scan a site in a fashion similar to that used with a handheld detector. Sample vapor flows through the vapor transport line to the manifold where it becomes ionized by the DART gas stream before entering into the mass spectrometer for analysis. The present invention may be used to raster a surface to determine the precise location of chemical contamination. Additionally, the invention may be used to tune or calibrate a DART-MS.

DESCRIPTION OF DRAWINGS

Like reference symbols in the drawings indicate like elements.

DETAILED DESCRIPTION

Figure 1:
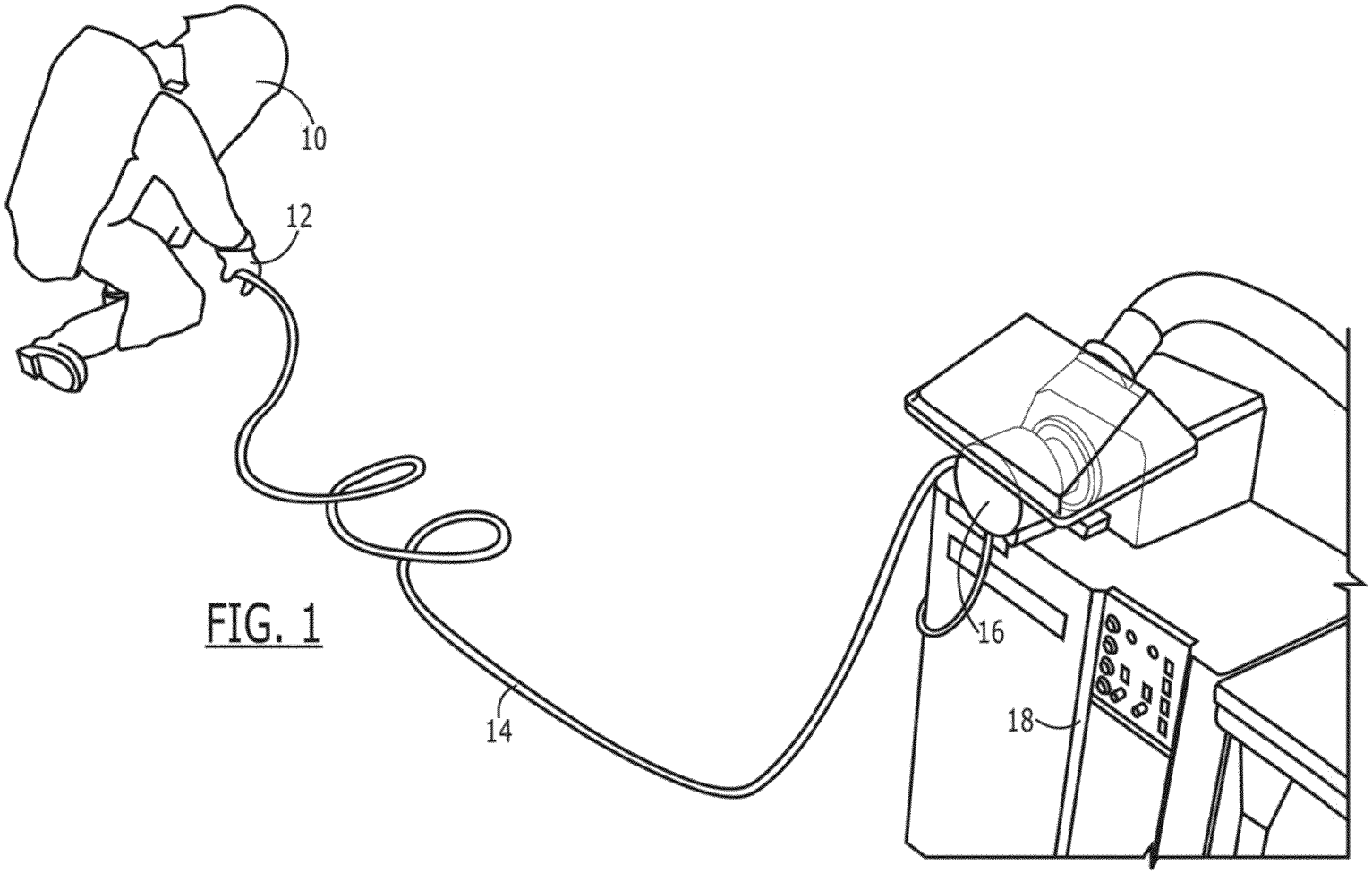
FIG. 1 is a perspective view of the present invention in use.

An embodiment of the present invention is illustrated in the perspective view of FIG. 1. User or operator 10 is wearing PPE typical of the operational requirements for areas potentially contaminated with chemical agent. As shown, operator 10 is probing location 12 at a distance of approximately 10 feet from DART-MS unit 18. The sample is being transported from sample location 12 to the DART ion source 16 of DART-MS unit 18 through a vapor transfer line 14. Vapor transport line 14 is of sufficient length and flexibility to allow operator 10 to easily move it throughout the site within an operational radius of approximately 20 feet from DART ion source 16. In this way, the site can be systematically scanned for chemical agent contamination using the highly accurate and reliable analytical capabilities of the DART-MS as opposed to a hand-held device. In addition, the output from the DART-MS is immediately available to operator 10 and others, which enhances safety and improves operational efficiency. For example, given the real-time readings from the DART-MS, the operator or a team member or supervisor can focus the raster or scanning pattern to pinpoint the precise location of chemical agent contamination. This enhances both the efficiency and safety of the operation.

Vapor transfer line 14 is preferably made of a substantially gas impermeable, chemical resistant material. In the preferred embodiment, the vapor transfer line 14 is heated and 20-feet in length, such as part number HTL-0207-2 from Quetron Systems, Inc. This heated transfer line conies with a 96-inch power cord and ⅛-inch connectors of the type sold under the trademark SWAGELOK. The reported equilibrium temperature for this heated line is 160 degrees Fahrenheit.

Figure 2:
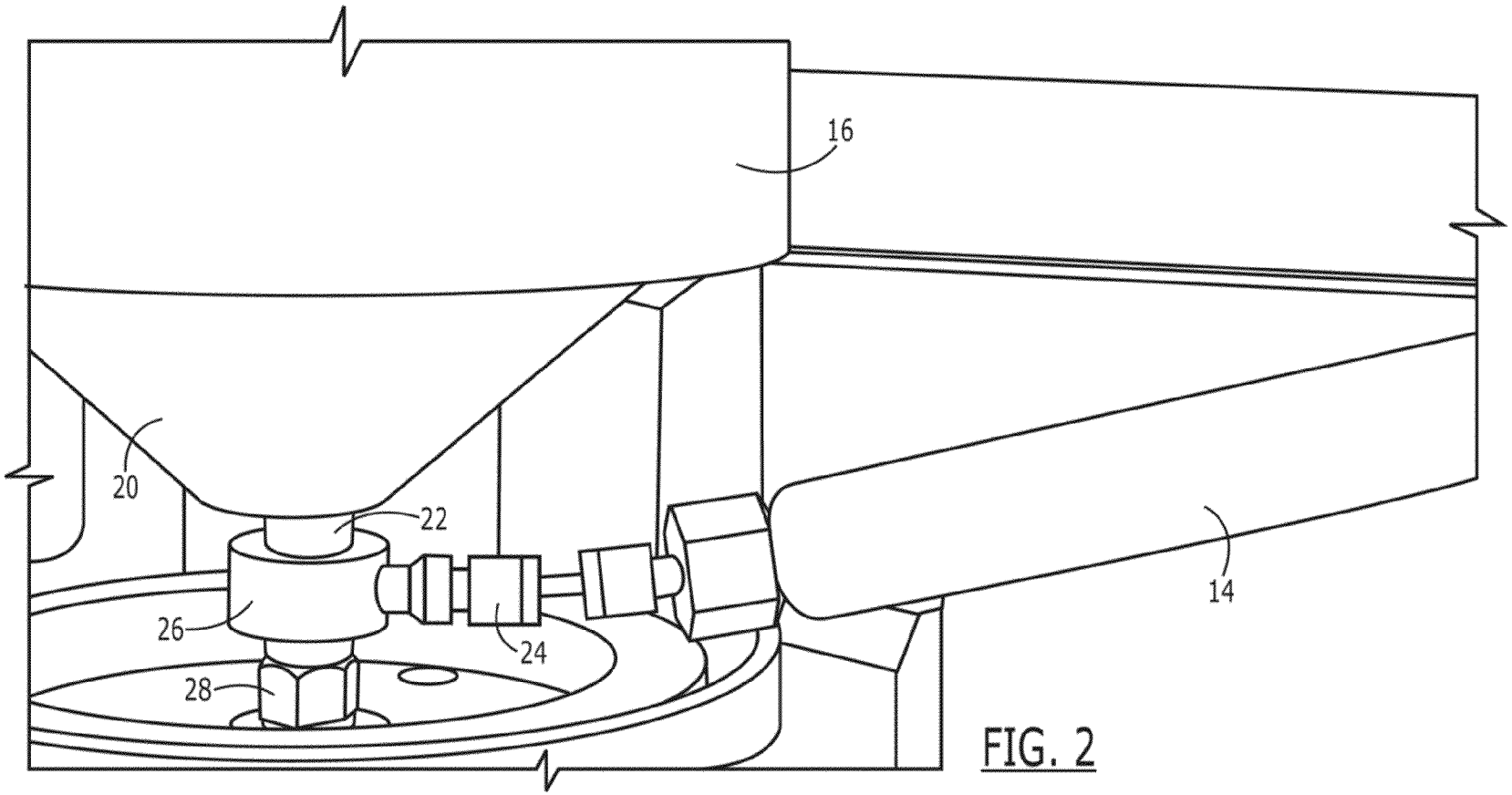
FIG. 2 is a perspective view of the vapor sampling components in relation to the ion source and VAPUR inlet adapter on the MS.

Turning to FIG. 2, a perspective view of the vapor transfer components in relation to the DART-MS is provided. The DART-MS includes DART ion source 16 and an adapter sampling port 28, which is referred to under the trademark VAPUR. The VAPUR adapter sampling port 28, as shown here includes a compression tube fitting. Manifold 26 in this particular embodiment includes a smooth walled insertion tube (not visible here) for connection to the compression tube fitting of port 28. The connection means used in a particular embodiment can be a compression fitting as illustrated herein, a threaded fitting, or a number of other mechanical connections or fastening means that are well known in the art to which the invention pertains. Manifold 26 in this embodiment includes a female threaded boring 22 that is screwed onto the outer housing 20 of DART ion source 16. Vapor transfer line 14 is connected to manifold 26 via fittings 24. As with the other fittings, the connection means used in various embodiments of the present invention can be a threaded fitting, a compression fitting, or a number of other connection or fastening means that are well known in the art. The key performance properties of these connections are that the fittings are substantially gas-tight, made of thermally and chemically resistant material, and can be readily connected and disconnected as needed by the user.

Figure 3:
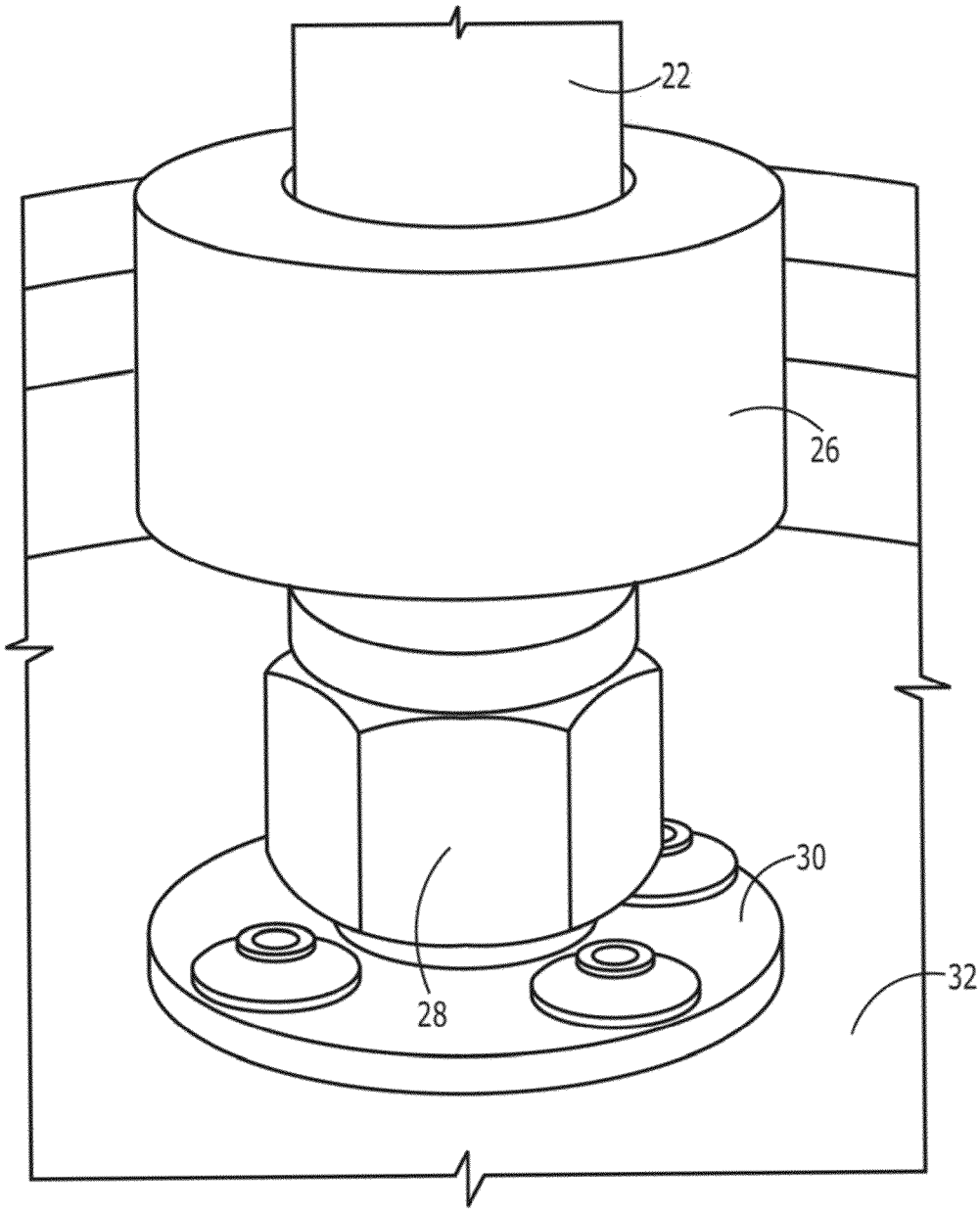
FIG. 3 is a detailed perspective view of a vapor sampling component connection means to the VAPUR inlet adapter on the MS.

A detailed perspective view of the DART-MS sampling port area is provided in FIG. 3 to illustrate the connection of manifold 26 to the compression tube fitting of the VAPUR adapter sampling port 28. As illustrated in this particular embodiment, the compression tube fitting of port 28 includes flange component 30 which is connected with bolts to wall 32 of the VAPUR adapter for the DART-MS.

Figure 4:
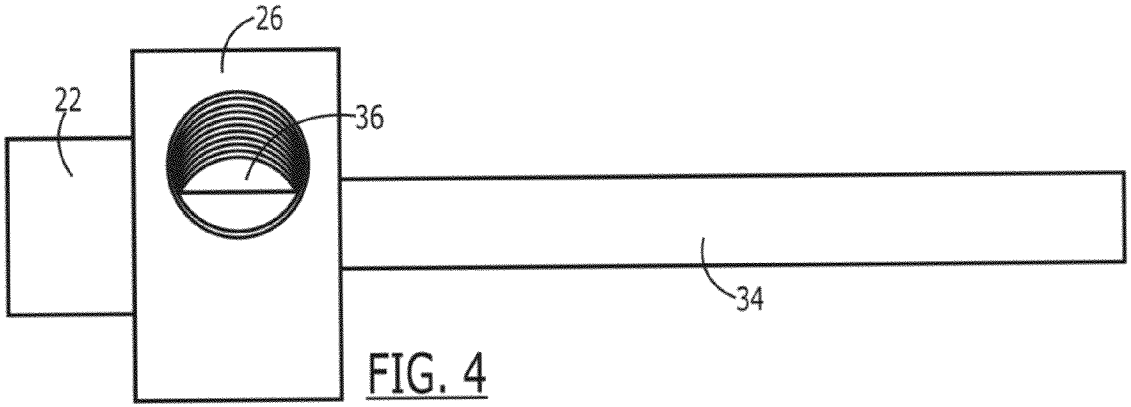
FIG. 4 is a detailed perspective view of a vapor sampling manifold for interfacing on one end to the DART ion source and on the other end to a VAPUR inlet adapter.

Turning to FIG. 4, a detailed perspective view of one embodiment of a vapor transfer manifold is provided. Manifold 26 in this particular embodiment includes a female-threaded fitting 22 for interfacing on one end to the DART ion source and an insertion tube 34 for interfacing on the other end to the VAPUR adapter sample port in accordance with the teachings of the present invention. Manifold 26 also includes a female-threaded port 36 for connection to the vapor transfer line. The interior of manifold 26 provides for unimpeded gas flow between and among fitting 22 connected to the DART ion source, insertion tube 34 inserted in the MS sample port, and port 36 to which the vapor transfer line is connected. In this way, vapor samples are continuously provided during operation of the present invention from the sample point flowing into manifold 26 where the vapor is exposed to the DART ion source before entering the MS through insertion tube 34.

The material used for manifold 26 is preferably made of a machinable, chemical resistant, non-conductive material that is resistant to heat up to at least 100 degrees Celsius. By way of example, a polymer thermoplastic such as polyether ether ketone (PEEK) can be used. Other materials, and fabrication methods other than machining, will be readily apparent to those skilled in the art. For example, injection molding could be used to manufacture manifold 26. In addition, a number of other suitable materials are readily available, such as machinable ceramic. Also, the shape and size of manifold 26 can vary while still performing the functions as taught herein.

Figure 5:
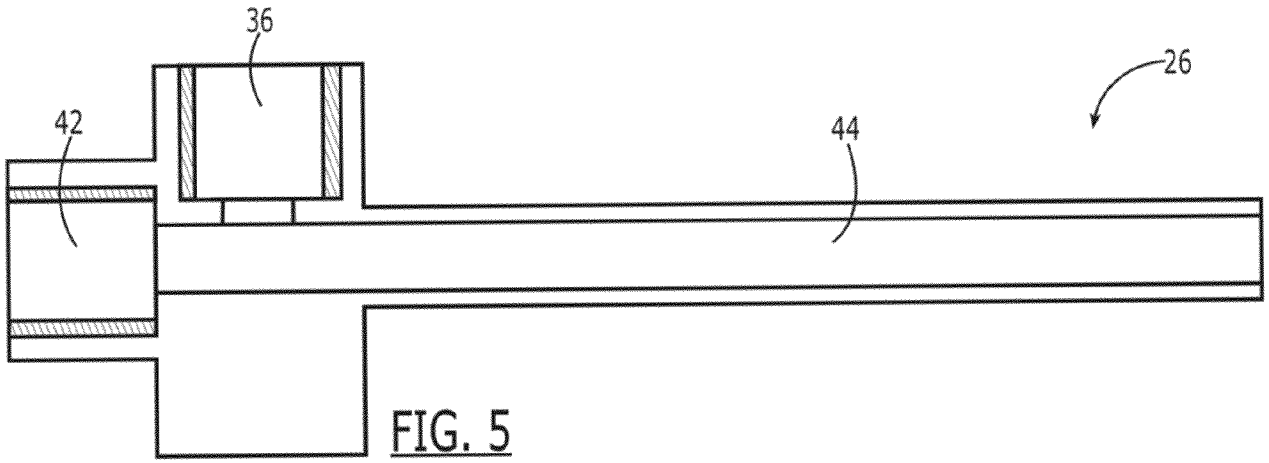
FIG. 5 is a cross-section of the vapor sampling manifold.

Turning to FIG. 5, a cross-section of vapor transfer manifold 26 is illustrated. Manifold 26 includes a sample tube flow path 44 in communication with aperture 36 and aperture 42, both of which have female threads in this particular embodiment. In operation, vapor from vapor sample line 14 (not shown here) flows into manifold 26 through aperture 36 where it is in proximity to the DART source located near aperture 42. The vapor then flows into the MS (not shown) through sample tube flow path 44.

Figure 6:
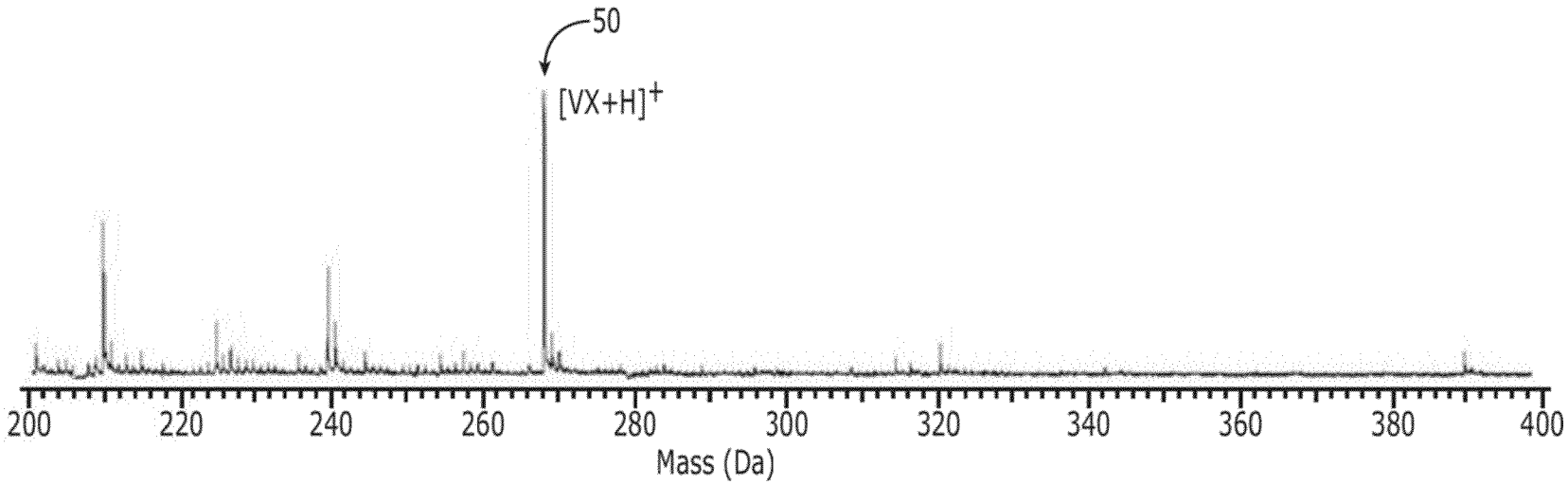
FIG. 6 is a graph illustrating the capability of the present invention to detect trace contaminations of the chemical warfare agent at a distance of approximately 10 feet from the DART-MS.

Having described the various hardware components of the present invention, attention is now turned to its operation. FIG. 6 is a graph illustrating the capability of the present invention to detect trace contaminations in the amount of 10 nanograms (ng) of the chemical warfare agent VX at a distance of approximately 10 feet from the DART-MS. Even with such a small quantity of agent (10 ng) at a total travel distance of 10 feet from the instrument, the signal as illustrated in FIG. 6 shows a clear peak 50 corresponding to the moment when the sample point was placed over the agent, allowing for a brief travel-time delay due to the required flow time of the sample through the vapor transport line to manifold and DART-MS. The duration of the delay was approximately five seconds, which is completely acceptable in the operational situation for which the invention is intended.

Figure 7:
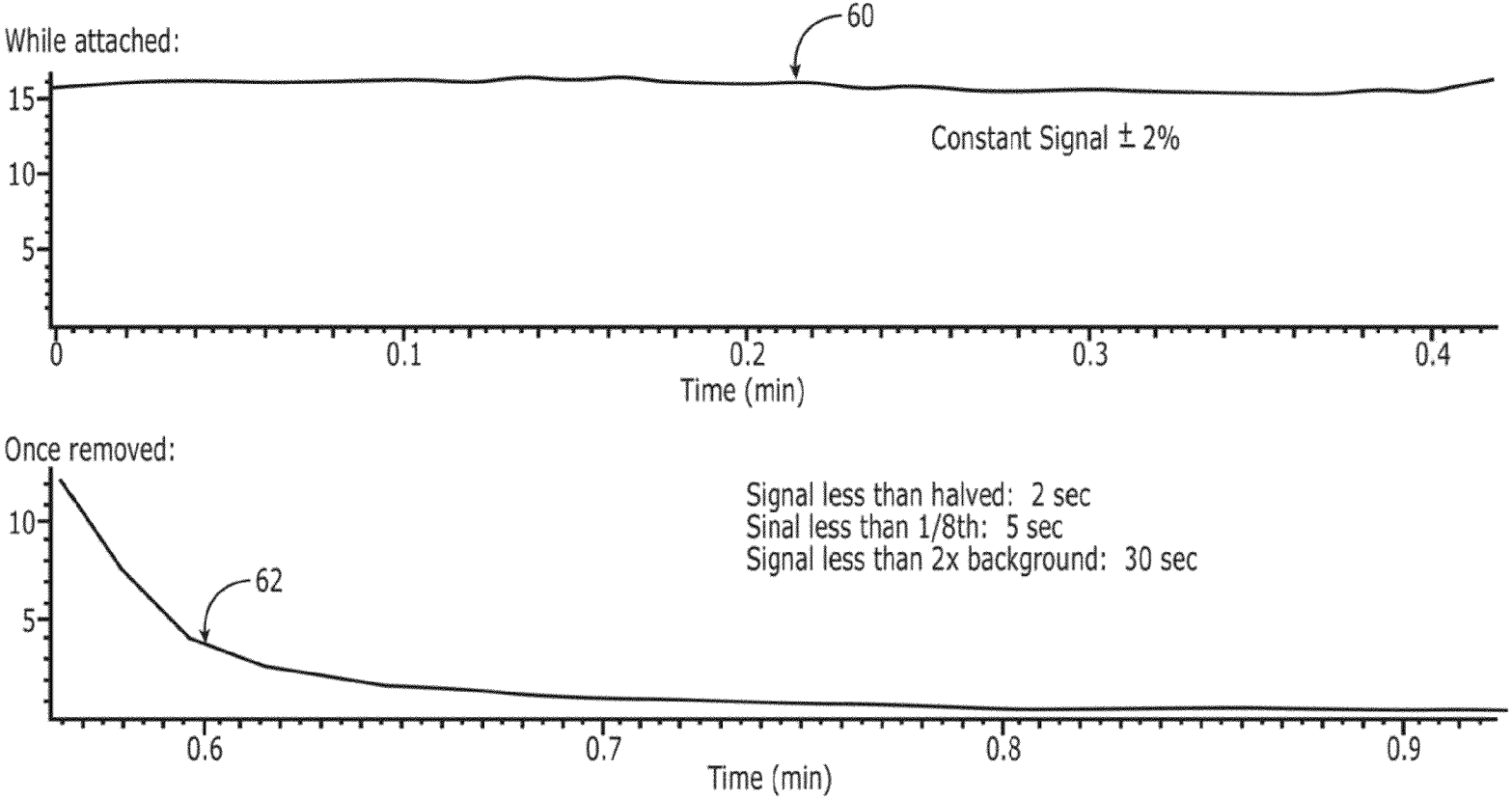
FIG. 7 is a comparison graph illustrating a DART-MS tuning capability provided by using the present invention to sample from a bubbler and selectively disconnecting from the bubbler.

Turning to FIG. 7, two graphs are used to illustrate the DART-MS tuning or calibration capability provided by the present invention. In the example illustrated here a vapor sample is taken from a bubbler containing tributyl phosphate using the present invention to generate a constant signal as illustrated in data line 60 of the top graph in FIG. 7. When the present invention is selectively disconnected from the bubbler, the signal returns quickly to background level as illustrated in data line 62 of the bottom graph in FIG. 7. The stable constant signal provided in this way is very useful for tuning instrument sensitivity.

Figure 8:
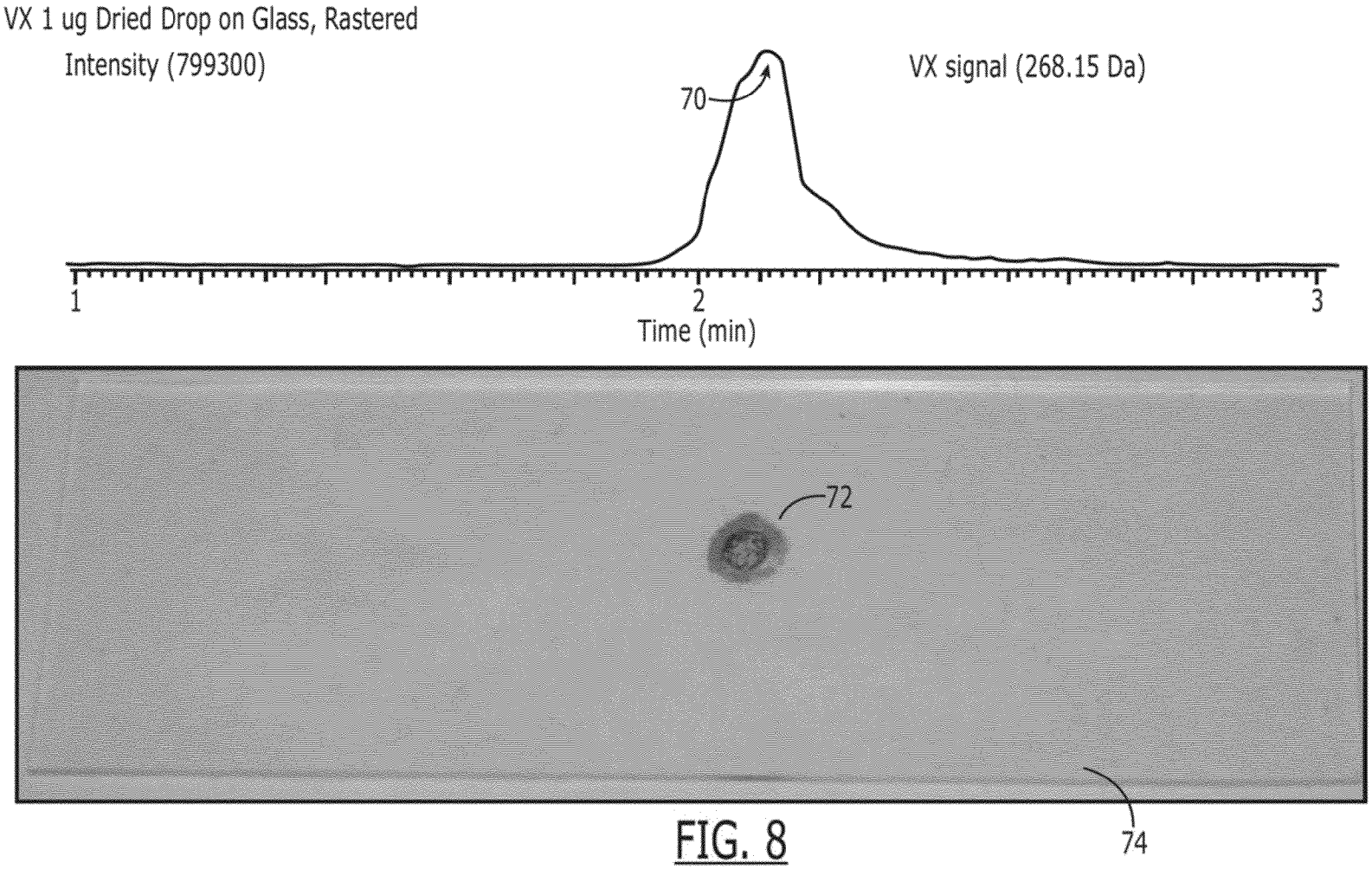
FIG. 8 is a raster plot of a glass slide sample surface to illustrate the raster capability of the present invention to locate a chemical contaminant.

Turning to FIG. 8, a raster plot and corresponding glass slide sample surface which is contaminated with a trace quantity of VX and blue dye are provided to illustrate the raster capability of the present invention to locate a chemical contaminate. By rastering or systematically moving the inlet to the vapor transfer line over a surface, the signal becomes most intense when the inlet is directly over the contamination. Experiments with the present invention indicate that when the inlet is scanned across a glass slide where 1 microgram (μg) of VX (with blue coloring added) has been deposited, the mass spectral signal creates a one-dimensional map, locating the contamination. For a two-dimensional surface the process can repeated, each time offsetting the sweep by the image resolution of the device. In this way, the specific location of contamination on a surface can be mapped. This information can then be used to direct decontamination measures.

While specific embodiments of the invention have been described, it will be understood that additional embodiments and various modifications may be made without departing from the spirit and scope of the invention. For example, various materials can be used for the manifold and vapor transport line as taught herein. The vapor transport line can be heated or unheated. Various mechanical fittings and connectors can be used to connect one component to another. Variations in manifold shape and size are possible while still performing the functions as taught herein. Accordingly, these and other embodiments of the invention fall within the scope of the following claims.

What is claimed is:

1. A vapor sampling adapter for use with a direct analysis in real time mass spectrometer, said mass spectrometer having an ion source and a sample port, comprising:

a vapor transport line having an inlet end and an outlet end for transporting sample vapor; and a manifold having a first manifold port for connecting said manifold to said outlet end of said vapor transport line, a second manifold port for connecting said manifold to said mass spectrometer ion source, and a third manifold port comprising an insertion tube inserted in the mass spectrometer sample port for connecting said manifold to said mass spectrometer sample port;

wherein said sample vapor flows from the inlet end of said vapor transport line through the vapor transport line to said manifold where it mixes with gas entering from said ion source before entering into said sample port where it is analyzed by said mass spectrometer.

2. A vapor sampling adapter as recited in claim 1, wherein said vapor transport line is a heated line.

3. A vapor sampling adapter as recited in claim 2, wherein said vapor transport line is a heated line maintained at a temperature in the range of 140 to 180 degrees Fahrenheit.

4. A vapor sampling adapter as recited in claim 1, wherein said manifold is made of a polymer thermoplastic.

5. A vapor sampling adapter as recited in claim 4, wherein said manifold is made of polyether ether ketone.

6. A vapor sampling adapter as recited in claim 1, wherein said inlet end and said outlet end of the vapor transport line include threaded fittings.

7. A vapor sampling adapter as recited in claim 1, wherein said first manifold port and said second manifold port include threaded fittings.

8. A vapor sampling adapter as recited in claim 1, wherein said inlet end and said outlet end of the vapor transport line include compression fittings.

9. A vapor sampling adapter as recited in claim 1, wherein said first manifold port and said second manifold port include compression fittings.

* * * * *